United States Patent [19]

Jongewaard et al.

[11] Patent Number: 5,061,678

[45] **Date of Patent: * Oct. 29, 1991**

[54] THERMAL TRANSFER IMAGING USING SULFONYLAMINOANTHRAQUINONE DYES

[75] Inventors: Susan K. Jongewaard, North St. Paul; Louis M. Leichter, Mendota Heights; Terrance P. Smith, Woodbury; Krzysztof A. Zaklika, St. Paul, all of Minn.

[73] Assignee: Minnesota Mining and Manufacturing Company, St. Paul, Minn.

[ * ] Notice: The portion of the term of this patent subsequent to Dec. 11, 2007 has been disclaimed.

[21] Appl. No.: 606,177

[22] Filed: Oct. 31, 1990

Related U.S. Application Data

[63] Continuation of Ser. No. 384,158, Jul. 21, 1989, Pat. No. 4,977,134.

[51] Int. Cl.[5] ..... B41M 5/035; B41M 5/26

[52] U.S. Cl. ..... 503/227; 8/471; 428/195; 428/336; 428/913; 428/914

[58] Field of Search ..... 8/471; 428/195, 337, 428/913, 914, 336; 503/227

[56] References Cited

U.S. PATENT DOCUMENTS

| | | | |
|---|---|---|---|
| 4,564,574 | 1/1986 | Uytterhoeven et al. | 430/115 |
| 4,618,557 | 10/1986 | Dan et al. | 430/114 |
| 4,798,778 | 1/1989 | Scott | 450/31 |

*Primary Examiner*—Bruce H. Hess

*Attorney, Agent, or Firm*—Gary L. Griswold; Walter N. Kirn; Mark A. Litman

[57] ABSTRACT

Alkylsulfonylamino- and arylsulfonylaminoanthraquinone dyes are useful for thermal dye transfer imaging, when employed in dye donor sheets. These dyes give images having excellent light and heat fastness.

25 Claims, No Drawings

THERMAL TRANSFER IMAGING USING SULFONYLAMINOANTHRAQUINONE DYES

CROSS-REFERENCE TO RELATED CASES

This is a continuation of application Ser. No. 07/384,158 filed July 21, 1989, now U.S. Pat. No. 4,977,134.

Some of the dyes included in the claims of the present case are included in examples of eutectic combinations of dyes for thermal imaging in 3M patent application Ser. No. 193,947 filed on May 13, 1988, now U.S. Pat. No. 4,857,503.

BACKGROUND TO THE INVENTION

FIELD OF INVENTION

This invention relates to thermal imaging and, more particularly, to anthraquinone dyes bearing sulfonylamino substituents which are useful for thermal dye transfer imaging.

BACKGROUND OF THE ART

The term thermal printing covers two main technology areas. In thermal transfer printing of textiles, a donor sheet is coated with a pattern of one or more dyes, contacted with the fabric to be printed, and heat is uniformly administered, sometimes with concomitant application of a vacuum. The transfer process has been much studied, and it is generally accepted that the dyes are transferred by sublimation in the vapor phase. Pertinent references include: C. J. Bent et al., *J. Soc. Dyers Colour.*, 85, 606 (1969); J. Griffiths and F. Jones, *ibid.*, 93, 176, (1977); J. Aihara et al., *Am. Dyest. Rep.*, 64, 46 (1975); C. E. Vellins in "The Chemistry of Synthetic Dyes", K. Venkataraman, ed., Vol. VIII, 191, Academic Press, New York, 1978.

The other area covered by the term thermal printing is thermal imaging, where heat is applied in an imagewise fashion to a donor sheet in contact with a suitable receptor sheet to form a colored image on the receptor. In one embodiment of thermal imaging, termed thermal mass transfer printing, as described for instance in U.S. Pat. No. 3,898,086, the donor is a colorant dispersed in a wax-containing coating. On the application of heat, the construction melts or is softened and a portion of the colored donor coating transfers to the receptor. Despite problems with transparency, pigments are generally the colorants of choice in order to provide sufficient light fastness of the colored image on the receptor. Another embodiment is termed variously thermal dye transfer imaging or recording, or dye diffusion thermal transfer. In this embodiment, the donor sheet comprises a dye in a binder. On imagewise application of heat, the dye, but not the binder, is transferred to the receptor sheet. A recent review has described the transfer mechanism as a "melt state" diffusion process quite distinct from the sublimation attending textile printing. (See: P. Gregory, *Chem. rit.*, 25, 47 (1989)).

This same review emphasizes the great difficulty of developing dyes suitable for diffusive thermal transfer, stating that "It is significant that of the one million or so dyes available in the world, none were fully satisfactory". Among the failings of said dyes are inadequate light and heat fastness of the image and insufficient solubility of dyes for coating in the donor sheet. As has been noted previously, light fastness is also a problem in mass transfer imaging systems. In fact, achieving adequate light fastness is probably the single biggest challenge in these constructions. In large measure this is the result of the diffusive thermal transfer dye image being a surface coating a few microns thick. The dye is thus readily susceptible to photooxidative degradation. In contrast, textile fibers, which are 100 times thicker, are uniformly dyed throughout their depth, so that fading in the first few microns at the surface is of little practical importance. In consequence, it is common to find that dyes showing good light fastness in textile printing exhibit very poor photostablity in diffusive thermal transfer imaging (see e.g., U.S. Pat. No. 4,808,568), and there remains a strong need for improved dyes for the latter application.

Although thermal printing of textiles bears a superficial resemblance to diffusive thermal dye imaging, in reality quite different processes with distinct properties and material requirements are involved. Thermal printing occurs by a sublimation process, so that substantial vapor pressure is a prime criterion for dye selection. In diffusive dye imaging, high vapor pressure of the dye contributes to undesirable thermal fugacity of the image. For the melt state diffusion process involved in this situation, melting point is instead a better basis for dye selection. Diffusive dye transfer is a high resolution dry imaging process in which dye from a uniform donor sheet is transferred in an imagewise fashion by differential heating to a very smooth receptor, using heated areas typically of 0.0001 square inches or less. In contrast, the thermal printing of textiles is of comparatively low resolution, involving contemporaneous transfer by uniform heating of dye from a patterned, shaped or masked donor sheet over areas of tens of square feet. The typical receptors printed in this manner are woven nor knitted fabrics and carpets. The distinct transfer mechanism allows such rough substrates to be used, while diffusive imaging, where receptors with a mean surface roughness of less than 10 microns are used, is unsuitable for these materials. Unlike diffusive thermal dye imaging, the transfer printing process is not always a dry process; some fabrics or dyes require pre-swelling of the receptor with a solvent or a steam post-treatment for dye fixation. Though the transfer temperatures for the two processes can be similar (180° to 220° C.), diffusive dye transfer generally operates at somewhat higher temperatures. However, in a manner strikingly reflective of the differences in mechanism involved, diffusive dye transfer involves times of around 5 msec, whereas thermal printing normally requires times of 15 to 60 sec. In accord with the sublimation process involved, thermal printing often benefits from reduced atmospheric pressure or from flow of heated gas through the donor sheet. Thermal printing is a technology developed for coloring of textiles and is used to apply uniformly colored areas of a predetermined pattern to rough substrates. In contradistinction, diffusive dye transfer is a technology intended for high quality imaging, typically from electronic sources. Here, a broad color gamut is built with multiple images from donors of the three primary colors onto a smooth receptor. The different transfer mechanism allows the requirement for grey scale capability to be fulfilled, since the amount of dye transferred is proportional to the heat energy applied. In thermal printing grey scale capability is expressly shunned, because sensitivity of transfer to temperature decreases process latitude and dyeing reproducibility.

It now has been found that anthraquinone dyes bearing alkyl- or arylsulfonylamino groups can be beneficially used in thermal dye transfer imaging. When these dyes are used in dye donor constructions, the resultant transferred images exhibit improved light and heat fastness over comparable materials known in the art. Surprisingly, many of these dyes are conventional materials well known in the art. Others, however, are novel and are described in copending application Ser. No. 07/384,157, now U.S. Pat. No. 5,034,547, filed the same day as this application. The latter additionally offer improved solubility in the hydrocarbon solvents required for dye donor sheet coating.

Very little mention is made of sulfonylaminoanthraquinone dyes in the thermal printing art. European Pat. No. 20292 A1 describes an auxiliary support for the thermal printing of textiles, characterized by porosity or perforations permitting a specified air flow, and coated with a pattern of dyes to be transferred to the fabric. The dyes are specified as those which volatilize without significant decomposition below 10° C., and whose volatility is less than that of the least volatile of the colorants used for classical printing by transfer in the gas phase. Among other dyes, 1-(4'-tolylsulfonylamino)-4-hydroxyanthraquinone is described as suited to this application. In Example 3 of this disclosure, this dye is described as giving a violet ink. Since this dye is in fact orange, it is likely a misidentification has been made. A plausible alternative structure would be 1-(4'-tolylamino)-4-hydroxyanthraquinone, which is mentioned in claim 10 of said patent. Auxiliary supports are again described in U.S. Pat. No. 4,369,038, which are useful for thermal printing of cotton fibres swollen with polyethylene glycol. The dyes to be used on said sheet are characterized as giving poor density of dyeing when applied under the conventional conditions of 35 seconds at 205° C., but giving dyeings of densities comparable to those of dyes used effectively under conventional conditions only when applied at 235° C. under a reduced pressure of 50 to 120 mbars (i.e about 0.05 to 0.12 atm). It is further required that the dyes change to the vapor state below 320° C. at atmospheric pressure. 1-amino-2-methoxy-4-(4'-tolylsulfonylamino)anthraquinone is mentioned as a dye which can be used for this purpose. The same dye is disclosed in U.S. Pat. No. 4,682,983, which claims a transfer sheet for heat transfer printing of textile materials which contain cellulosic fibers pretreated for swelling, said sheet comprising a flexible substrate coated with a release layer to which is applied a dyestuff coating or design. The dyestuff coating is characterized as a mixture of a binder and at least one disperse or vat dyestuff. This dyestuff has further additional characteristics: it does not "sublimate" in conventional heat transfer printing; it has an optical density not exceeding 0.3 as a saturated solution in boiling 0.1 molar aqueous sodium carbonate; it is transferred at no more than 40% by weight under conventional transfer conditions (200° C., 30 seconds, normal atmospheric pressure) and with relatively low contact pressure (5 kPa); it is transferred more than 60% by weight under high contact pressure (50 kPa) at 230° C. for 30 seconds at a reduced atmospheric pressure of 10,000 Pa (about 0.1 atm).

Japanese Kokai JP48-01387 describes a method of heat-transfer printing of cellulose with reactive sublimation dyes, in which the cellulose is pretreated with acid absorber and reaction accelerator. Among a range of reactive dyes disclosed are anthraquinone dyes bearing a 1-NHX group and a 4-hydroxy or 4-amino group and also anthraquinone dyes having a 1-NMeX-2-cyano-4-hydroxy substitution pattern. The group X includes $-SO_2CH_2CH_2Cl$ and $-SO_2CH{=}CH_2$. The explicit example of 1-vinylsulfonylamino-4-aminoanthraquinone is provided, which is described as a blue dye, but is more likely magenta.

The thermal printing art for textiles discloses only 1-vinylsulfonylamino- and 1-(2'-chloroethylsulfonylamino)anthraquinones bearing additional auxochromic substituents, along with 1-amino-2-methoxy-4-(4'-tolylsulfonylamino)anthraquinone. These are characterized as sublimation dyes, and are uniformly transferred to substrates which require special pretreatment. The conditions of use are far removed from those which obtain for the different process of diffusive thermal dye imaging. There is, thus, no thermal printing art which is directly pertinent to the present invention.

Many sulfonylaminoanthraquinone dyes are well-known in the dyeing art. Thus, 1-amino-2-OR-4-alkylsulfonylaminoanthraquinones (R being alkyl or aryl) are described in U.S. Pat. Nos. 3,072,683, 3,391,164, 3,763,192, 3,894,060, and in British Pat. Nos. 1,015,505 and 1,478,022. Similar 1-amino-2-thioalkyl-4-alkylsulfonylaminoanthraquinones are disclosed in U.S. Pat. Nos. 2,640,059, 3,394,133, 3,642,425 and 3,822,992. Also known are the 1-amino-2-sulfo-4-alkylsulfonylaminoanthraquinones (see U.S. Pat. No. 1,928,725 and British Pat. No. 790,952), but these are less desirable in thermal dye transfer imaging because of the presence of the ionizable sulfo group limits compatibility with the hydrocarbon-based binders and solvents used in the dye donor sheets. Other alkylsulfonylaminoanthraquinone derivatives can be found in U.S. Pat. Nos. 3,532,723 and 3,350,425. Anthraquinones with more than one alkylsulfonylamino substituent are mentioned in U.S. Pat. No. 3,209,016 and in the abstract of Japanese Kokai No. 63-258955. Among the arylsulfonylaminoanthraquinones a wide variety of 1-amino-2-OR-4-arylsulfonylaminoanthraquinones are known. These are disclosed, for example, in U.S. Pat. Nos. 1,948,183, 3,087,773, 3,428,411, 3,467,681, 3,507,606, and 4,110,072. Other arylsulfonylamino-derivatives are described in U.S. Pat. Nos. 1,939,218, 3,240,551, 3,486,837 and 3,734,933, in German Pat. Nos. 623,069 and 647,406, in U.S. Defensive Publication U.S. Pat. No. T873,014, and in R. H. Hall and D. H. Hey, *J. Chem. Soc.*, 736 (1948).

SUMMARY OF THE INVENTION

This invention relates to novel thermal dye transfer constructions, and in particular to dye donor elements.

This invention further relates to donor elements based on arylsulfonylamino- and alkylsulfonylamino-substituted anthraquinones.

A further aspect of this invention is the provision of dye donor elements which, when imaged, give rise to dye images of excellent light and heat fastness.

This invention describes thermal dye transfer compositions (dye donors) which, when heated in an imagewise fashion, result in the imagewise transfer of dye to a receptor sheet. The compositions of the invention comprise a polymeric binder and at least one anthraquinone dye, the anthraquinone nuclear aromatic carbon atoms of which are substituted with at least one arylsulfonylamino or preferably at least one alkylsulfonylamino group in a position peri to the carbonyl group (i.e., in the alpha position of the anthraquinone nucleus).

DETAILED DESCRIPTION OF THE INVENTION

The process of dye diffusion thermal transfer consists of contacting a dye donor sheet with a suitable receptor sheet and applying heat in an imagewise fashion to transfer the dye to the receptor. Generally, the transfer process involves temperatures up to 400° C. and times of a few milliseconds. In addition to providing an image of acceptable density and of correct color, the dye must provide good light fastness and heat stability in the image. It is particularly desirable that the dye transfers in proportion to the heat applied, so that a good grey scale of coloration can be obtained.

Thermal transfer imaging is a dry diffusive dye imaging process consisting essentially of the steps of: (1) intimately contacting a donor sheet comprising a dye with an acceptor sheet having a root mean square surface roughness of less than about 10 microns; (2) differentially heating the assembly with a source of thermal energy in an imagewise fashion thereby transferring the dye to the receptor sheet; and (3) separating the donor and acceptor sheets. The size of an individual differentially heated area (pixel) preferably ranges from about $5\times10^{-6}$ to $1\times10^{-2}$ cm$^2$. The transfer time may range from about 1 to about 100 milliseconds. The donor sheet is capable of transferring an amount of dye proportional to the amount of thermal energy applied.

Some of the preferred dyes useful in the present invention may be generally described as having a central nucleus of the formula:

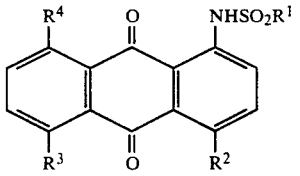

wherein $R^1$ is an alkyl group comprising two or more carbon atoms, and does not have a halogen substituent on the carbon alpha to the sulfur atom; $R^2$—$R^4$ may be any group other than auxochromic groups. Auxochromic groups may be undesirable in cases where yellow, orange, or red dyes are desired. The term auxochromic as used herein is defined as RS—, RO—, and $R_2N$— groups where R may be an alkyl or aryl group, or hydrogen.

A broad class of dyes useful in the present invention may be represented by a central nucleus of the formula:

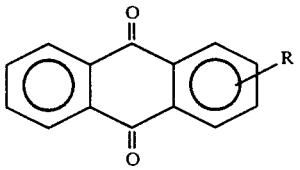

wherein R is $NHSO_2R''$, and R″ is alkyl group, aryl group, or a heterocyclic group. R″ is an alkyl of 1 to 20 carbon atoms, an aryl group of up to 20 carbon atoms, or a heterocyclic group of up to 16 carbon atoms. The core anthraquinone nucleus may or may not have additional groups bonded thereto.

More particularly, the anthraquinone dye is selected from those with a general structure:

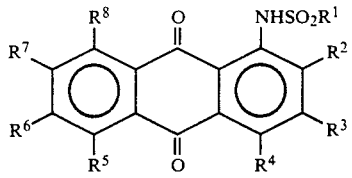

where $R^1$ is selected from $R^9$ and $R^{10}$, $R^9$ is alkyl of 1 to 20 carbon atoms, or alkyl of 1 to 20 carbon atoms substituted with one or more of fluoro, chloro, bromo, hydroxy, amino, and alkoxy, alkylthio, monoalkylamino and dialkylamino each with alkyl groups of 1 to 10 carbon atoms, (preferably $R^1$ is an alkyl group free of vinyl and halogen substituents), $R^{10}$ is aryl of 5 to 20 carbon atoms, or aryl or heteroaryl of 5 to 20 carbon atoms substituted with one or more of $R^9$, fluoro, chloro, bromo, nitro, sulfonyl, cyano, carbonyl, hydroxy, amino, and $R^9O$—, $R^9S$—, $R^9NH$— and $R^9R^9N$—, $R^2$ to $R^8$ are independently selected from hydrogen, fluoro, chloro, bromo, nitro, cyano, $R^1SO_2NH$—, $R^{11}NH$—, $R^{11}O$—, $R^{11}S$—, $R^{11}(CO)O$—, $R^{11}(CO)NH$—, $R^{11}(CO)$—, $R^{11}O(CO)$—, $R^{11}R^{11}N(CO)$—, $R^{11}SO_2$—, $R^{11}R^{11}NSO_2$—, and groups $R^{11}$ are independently selected from hydrogen, $R^9$, and $R^{10}$.

The dyes may alternatively be more narrowly defined according to either of the following definitions:

1) An anthraquinone dye having from 1 to 4 alpha $RSO_2NH$— groups, wherein R is an alkyl or aryl group, and the anthraquinone nucleus is free of $NH_2$ and OH substituents.

2) An anthraquinone dye having from 1 to 4 alpha $RSO_2NH$— groups, wherein R is an alkyl group free of fiber reactive groups.

It is preferred that the dye be free of ionizable or ionic, water-solubilizing groups such as sulfo and carboxy and their salts.

The donor element may have a variety of structures, including a self-supporting single layer or a layer or coating on various substrates in combination with other layers, and may be used in a number of different imaging processes, including imaging with thermal print heads and with lasers.

The dye donor constructions of this invention provide transferred dye images which have excellent heat and light fastness.

The dye donor sheet for this process comprises a dye ink coated on suitable substrate, though a self-sustaining film comprising the dye is also a possiblity. The carrier sheet is preferably flexible, but may be rigid if the receptor layer is sufficiently flexible and/or conformable. The substrate may thus be glass, ceramic, metal, metal oxide, fibrous materials, paper, polymers, resins, and mixtures or layers of these materials. For backside thermal exposure with a thermal print head, example substrates include polyester, polyimide, polyamide, polyacrylate, polyalkylene and cellulosic films, and paper, especially the uniform high-quality paper known as condenser paper. It may be desirable to apply a backsize to the substrate on the side away from the dye to protect it from the heat source or to prevent sticking to the thermal element. The thickness of the resultant substrate may vary within wide limits depending on its thermal properties, but is generally below 50 microns, and preferably less than 12 microns and more preferably less than 10 microns. If a front thermal exposure is used, for instance when a laser irradiates the dye through a transparent receptor sheet, the substrate may be of arbitrary thickness.

The dye ink applied to the donor sheet comprises a sulfonylaminoanthraquinone dye as defined above, and usually a suitable binder. Other additives such as plasticizers, stabilizers or surfactants may also be present, as is known in the art. Suitable binders are polymeric materials such as: polyvinyl chloride and its chlorinated derivatives; polyesters; celluloses, such as cellulose acetate, cellulose acetate butyrate, ethyl-cellulose and the like; epoxy resins; acrylates, such as polymethyl methacrylate; vinyl resins, such as polyvinyl acetate, polyvinyl butyral, polyvinyl pyrrolidone and polyvinyl alcohol; polyurethanes; polysiloxanes; copolymers, such those derived from polyacrylates or polyalkylene materials; and blends or mixtures of these various polymers. Chlorinated polyvinyl chloride has been found especially useful, particularly when used in mixtures with polyesters or acrylates. The dye may be present in the binder in the dissolved state, or it may be dispersed with at least some crystalline dye present. In some cases as much as 99% by weight of dye may be used (with other additives excluding binder), but a more typical range could be about 90% to 15% by weight of dye. A preferred range is from 70% to 40% by weight of dye in multilayer constructions. A self-supporting element may contain 20% by weight of binder, and preferably as much as 40% by weight of binder.

In general, it is desired to formulate the donor such that the dye, but substantially none of the donor element binder, is transferred to the receptor. However, in some cases valuable constructions can be prepared in which the dye along with a significant, or indeed major, portion of the binder is transferred in a mass transfer process.

The receptor sheet may be transparent, translucent or opaque. It may be a single layer or a laminate. Particularly useful constructions can be made when the receptor is applied to a transparent polyester film or to a paper substrate. The receptor sheet may comprise a wide variety of polymers or their mixtures. Suitable materials are similar to those outlined above for the binder of the donor sheet. Especially useful results can be obtained with receptors where the major component is chlorinated polyvinyl chloride. The receptor may additionally contain various additives, such as heat and light stabilizers or coating aids. While the exact nature of the receptor may influence the quality and fastness of the image, it has been found that the excellent stability of the dyes of this invention is a property of the dye image itself and not of the receptor composition.

The object of providing stable thermally transferred dye images is achieved in this invention by the use of at least one sulfonylamino-substituted anthraquinone dye within the donor sheet. The anthraquinone nuclear aromatic carbon atoms of these dyes are characterized by the presence of at least one arylsulfonylamino or alkylsulfonylamino group in a position peri to the carbonyl group. Other substituents such as: amino; alkylamino; arylamino; carbonylamino; hydroxy; alkoxy; aryloxy; thioalkyl; thioaryl; carbonyl and its derivatives such as aldehyde, ketone, ester and amide; sulfonyl; aminosulfonyl and its N-substituted derivatives; nitro; cyano; and the halogens fluoro, chloro, and bromo may also be present on the anthraquinone nucleus. It is preferred, however, that the dye be free of ionic or ionizable, water-solubilizing groups such as sulfo and carboxy and their salts. Both arylsulfonylamino- and alkylsulfonylaminoanthraquinones are useful, though the latter are preferred for their greater solubility in the solvents used for preparing dye donor sheets.

As is well understood in this technical area, a large degree of substitution is not only tolerated, but is often advisable. As a means of simplifying the discussion and recitation of these groups, the terms "group" and "moiety" are used to differentiate between chemical species that allow for substitution or which may be substituted. For example, the phrase "alkyl group" is intended to include not only pure hydrocarbon alkyl chains such as methyl, ethyl, pentyl, cyclohexyl, isooctyl, tert-butyl and the like, but also such alkyl chains bearing such conventional substituents in the art such as hydroxyl, alkoxy, phenyl, halo (F, Cl, Br, I,), cyano, nitro, amino, etc. The phrase "alkyl moiety" on the other hand is limited to the inclusion of only pure hydrocarbon alkyl chains such as methyl, ethyl, propyl, cyclohexyl, isooctyl, tert-butyl, and the like.

Many of these materials are well-known in the dyeing art as previously indicated. A particularly preferred class of dyes are the alkylsulfonylaminoanthraquinones free of auxochromic groups disclosed in our copending application U.S. Ser. No. 07/384,157, now U.S. Pat. No. 5,034,547 filed the same day as this application. These offer improved solubility over known corresponding arylsulfonylamino analogs, and provide yellow colors suitable for application to a full color subtractive imaging system. The performance of the dyes of this invention in diffusive thermal imaging systems is demonstrated in the following examples, with particular reference to image stability, especially with regard to light. These examples are intended to be illustrative, but not limiting. The dyes are useful and effective in a variety of other embodiments of thermal dye transfer imaging known to those with skill in the art.

EXAMPLES

The following is a description of the various coating formulations referred to in the examples of this patent. All dye donor sheets were coated with a number wire-wound coating rod (0.018 mm wet thickness) onto 5.7 micron Teijin F24G thermal film, which is representative of a thin polyester film, and dried in a current of air at ambient temperature. With the exception of commercially available dye receptor sheets, all receptor sheets were coated with a number 8 wire-wound coating rod onto 4 mil (0.10 mm) polyethylene terephthalate film and dried in a current of warm air.

Donor sheet A

The donor sheet was made from the following formulation:

| | |
|---|---|
| 0.03 g | dye |
| 0.025 g | Goodrich Temprite TM 678 × 512 62.5% chlorinated polyvinyl chloride (CPVC) |
| 0.007 g | 60/40 blend of octadecyl acrylate and acrylic acid |
| 1.50 g | tetrahydrofuran |
| 0.10 g | 2-butanone |

Donor sheet B

The donor sheet was made from the following formulation:

| | |
|---|---|
| 0.03 g | dye |
| 0.10 g | Aldrich 18,223-0 poly(methyl methacrylate), low molecular weight |
| 1.00 g | tetrahydrofuran |
| 2.00 g | 2-butanone |

Donor sheet C

The donor sheet was made from the following formulation:

| | |
|---|---|
| 0.06 g | dye |
| 0.04 g | Goodrich Temprite TM 678 × 512 62.5% CPVC |
| 0.007 g | 60/40 blend of octadecyl acrylate and acrylic acid |
| 0.003 g | Goodyear Vitel TM PE 200 polyester |
| 2.80 g | tetrahydrofuran |
| 0.15 g | 2-butanone |

Receptor Sheet A

The receptor sheet was made from the following formulation:

| | |
|---|---|
| 0.25 g | ICI 382ES bisphenol A fumarate polyester |
| 0.20 g | Goodrich Temprite TM 678 × 512 62.5% CPVC |
| 0.04 g | Shell Epon TM 1002 epoxy resin |
| 0.04 g | Goodyear Vitel TM PE 200 polyester |
| 0.05 g | 3M Fluorad TM FC 430 fluorocarbon surfactant |
| 0.015 g | Ciba-Geigy Tinuvin TM 328 UV stabilizer |
| 0.04 g | BASF Uvinul TM N539 UV stabilizer |
| 0.05 g | Ferro Therm-Check TM 1237 heat stabilizer |
| 0.08 g | Eastman Kodak DOBP TM 4-dodecyloxy-2-hydroxybenzophenone |
| 4.56 g | tetrahydrofuran |
| 1.85 g | 2-butanone |

Receptor Sheet B

The receptor sheet was made from the following formulation:

| | |
|---|---|
| 0.25 g | ICI 382ES bisphenol A fumarate polyester |
| 0.20 g | Goodrich Temprite TM 678 × 512 62.5% CPVC |
| 0.04 g | Shell Epon TM 1002 epoxy resin |
| 0.04 g | Goodyear Vitel TM PE 200 polyester |
| 0.02 g | Aldrich polyethylene glycol (MW 1000) |
| 0.05 g | 3M Fluorad TM FC 430 fluorocarbon surfactant |
| 0.12 g | Ciba-Geigy Tinuvin TM 292 UV stabilizer |
| 0.01 g | Ciba-Geigy Tinuvin TM 328 UV stabilizer |
| 4.50 g | tetrahydrofuran |
| 1.80 g | 2-butanone |

Receptor Sheet C

This receptor was Hitachi VY-S Video Print Paper TM, which was used as received, with dye transfer to the coated side.

Printer A

Thermal printer A used a Kyocera raised glaze thin film thermal print head with 8 dots/mm and 0.25 watts per dot. In normal imaging, the electrical energy varied from 2.64 to 6.43 joules/sq.cm, which corresponded to head voltages from 9 to 14 volts with a 4 msec pulse. Grey scale images were produced by using 32 electrical levels, produced by pulse width modulation or by variation of applied voltage.

Printer B

Thermal printer B used a Kyocera raised glaze thin film thermal print head with 8 dots/mm and 0.3 watts per dot. In normal imaging, the electrical energy varied from 0 to 10 joules/sq.cm, which corresponded to head voltages from 0 to 20 volts with a 4 to 10 msec pulse.

The photostability of transferred images produced with a range of alkylsulfonylaminoanthraquinone dyes is demonstrated in Example 1. It is uniformly excellent. Example 2 illustrates that good photostability can be obtained irrespective of the dye receptor layer used. In Example 3, photostability of additional dyes of this invention is compared against a reference azo dyestuff using two different irradiation sources. Again, except for the azo dye, good light fastness is found.

EXAMPLE 1

The tabulated anthraquinone dyes were incorporated into donor sheets using formulation A and imaged onto receptor sheet C using printer B. The transferred images were then exposed in an Atlas UVICON TM at 350 nm and 50° C. for the indicated times. The change in (L,a,b) color coordinates, DELTA E, was determined. A DELTA E of less than 2.0 is not discernable with the human eye. The results are given below.

| | DELTA E values | |
|---|---|---|
| Substitution | at 24 hr | at 48 hr |
| 1-n-propylsulfonylamino | 1.1 | — |
| 1,5-bis(n-octylsulfonylamino) | 0.8 | 2.4 |
| 1,4-bis(n-octylsulfonylamino) | 0.8 | 0.9 |
| 1,4,5-tris(n-octylsulfonylamino) | 2.3 | — |
| 1-amino-2-methyl-4-n-octyl-sulfonylamino | 3.1 | — |

EXAMPLE 2

1,4-bis(n-octylsulfonylamino)anthraquinone was imaged as in Example 1 onto both receptor A and receptor C. Photostability was evaluated as in Example 1, using a white backing for receptor A, with the results below.

| Receptor | DELTA E at 24 hrs |
|---|---|
| A | 2.7 |
| C | 0.9 |

Additionally, 1-n-octylsulfonylaminoanthraquinone gave a DELTA E value of 1.9 after 24 hrs of exposure under these conditions after imaging on receptor A.

EXAMPLE 3

The tabulated dyes were incorporated into donor sheets using formulation B and imaged onto receptor sheet B using printer A. The transferred images were then exposed in an Atlas UVICON TM for 24 hrs as in Example 1. DELTA E values were then determined. The images on this transparent receptor were also exposed for 24 hours on a 360 watt 3M Model 213 overhead projector and the percent change in image optical density was measured.

| | DELTA E UVICON TM | % density loss O/H projector |
|---|---|---|
| 1-(mesitylsulfonyl amino)anthraquinone | 2.0 | 0 |
| 1-methylsulfonylamino anthraquinone | 1.6 | 2 |
| 4-diethylamino-4'-methoxyazobenzene | ca. 60 | 20 |

In addition to providing good light fastness, the dyes of this invention also exhibit good thermal stability of the transferred image. This is often a problem in dye diffusion images. Example 4 illustrates the excellent results obtained.

EXAMPLE 4

1,4-bis(n-octylsulfonylamino)anthraquinone was imaged as in Example 1 onto receptor C and held at 50° C. for the times indicated. DELTA E values were determined as tabulated below.

| Elapsed time (hr) | DELTA E |
|---|---|
| 24 | 0.7 |
| 48 | 0.7 |

An effective thermal dye imaging system must transfer dye in direct proportion to the heat input in order to provide for true grey scale capability. An indicator of transfer efficiency of the dye (ITE) was computed as the ratio, expressed as a percentage, of the reflection optical density of the transferred image to the reflection optical density of the donor sheet prior to imaging. The ITE as a function of heat input was then determined. Accordingly, 1-n-octylsulfonylaminoanthraquinone was prepared in donor sheet C and imaged onto receptor A using printer A operated at various voltages. The ITE was strictly linearly dependent on applied voltage, as desired. The peak transfer efficiency is high and the donor readily reproduced 21 of 32 grey scale steps.

In addition to the dyes exemplified above, dyes such as 1-amino-2-methoxy-4-(4'-tolylsulfonylamino)anthraquinone, 1-hydroxy-4-(4'-tolylsulfonylamino)anthraquinone, 1,4-bis(4'-tolylsulfonylamino)anthraquinone and 1,5-bis(4'-tolylsulfonylamino)anthraquinone can be coated in donor sheets and transferred. These materials are, however, difficultly soluble and frequently give donor sheets with excessive crystallinity, which is undesirable from a functional standpoint. Image densities obtained with these dyes are also generally low.

We claim:

1. A thermal dye transfer imaging element comprising a continuous layer of at least one anthraquinone dye bonded to a substrate said dye having the general structure:

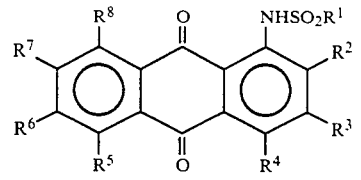

where $R^1$ is selected from $R^9$ and $R^{10}$, $R^9$ is alkyl of 1 to 20 carbon atoms, or alkyl of 1 to 20 carbon atoms substituted with one or more of fluoro, chloro, bromo, hydroxy, amino, and alkoxy, alkylthio, and monoalkylamino and dialkylamino each with alkyl groups of 1 to 10 carbon atoms, $R^{10}$ is aryl of 5 to 20 carbon atoms, or aryl of 5 to 20 carbon atoms substituted with one or more of $R^9$, fluoro, chloro, bromo, nitro, sulfonyl, cyano, carbonyl, hydroxy, amino, and $R^9O$—, $R^9S$—, $R^9NH$—, and $R^9R^9N$—, $R^2$ to $R^8$ are independently selected from hydrogen, fluoro, chloro, bromo, nitro, cyano, $R^1SO_2NH$—, $R^{11}NH$—, $R^{11}O$—, $R^{11}S$—, $R^{11}(CO)O$—, $R^{11}(CO)NH$—, $R^{11}CO$—, $R^9O(CO)$—, $R^{10}O(CO)$—, $R^{11}R^{11}N(CO)$—, $R^{11}SO_2$—, and $R^{11}R^{11}NSO_2$—, and groups $R^{11}$ are independently selected from hydrogen, $R^9$ and $R^{10}$.

2. The thermal dye transfer imaging element of claim 1 wherein no more than two of $R^2$ to $R^8$ are other than hydrogen.

3. The thermal dye transfer imaging layer of claim 2 wherein said dye is free of ionic of ionizable, water-solubilizing groups.

4. The thermal dye transfer imaging layer of claim 2 wherein said substrate has a thickness of less than 12 microns.

5. The thermal dye transfer imaging layer of claim 1 wherein said dye is free of ionic or ionizable, water-solubilizing groups.

6. The thermal dye transfer imaging layer of claim 1 wherein said substrate has a thicknesss of less than 12 microns.

7. The thermal dye transfer imaging layer of claim 1 wherein $R^2$—$R^8$ are chosen from hydrogen and $R^1SO_2NH$—.

8. A process for thermal dye transfer imaging comprising the steps of placing the continuous layer of the element of claim 1 against a receptor sheet and imagewise heating the substrate so as to transfer said dye to said receptor sheet.

9. A thermal dye transfer element according to claim 1 in which $R^1$ is an alkyl group free of vinyl and halogen substituents.

10. A thermal dye transfer element according to claim 1 in which $R^1$ is an alkyl moiety.

11. A thermal dye transfer imaging element comprising a continuous layer of at least one anthraguinone dye bonded to a substrate, said dye having a central nucleus of the formula:

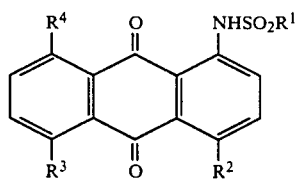

wherein $R^1$ is an alkyl group comprising two or more carbon atoms, and does not have a halogen substituent on the carbon alpha to the sulfur atom; $R^2$—$R^4$ may be any group other than auxochromic groups.

12. A thermal dye transfer imaging element as recited in claim 2 wherein said $R^1$ is alkyl group.

13. The thermal dye transfer imaging layer of claim 12 wherein said dye is free of ionic or ionizable, water-solubilizing groups.

14. The thermal dye transfer imaging layer of claim 12 wherein said substrate has a thickness of less than 12 microns.

15. The thermal dye transfer imaging element of claim 11 wherein no more than two of $R^2$ to $R^4$ are other than hydrogen.

16. The thermal dye transfer imaging layer of claim 15 wherein said substrate has a thickness of less than 12 microns.

17. The thermal dye transfer imaging element of claim 11 wherein said dye is free of ionic or ionizable, water-solubilizing groups.

18. A process for thermal dye transfer imaging comprising the steps of placing the continuous layer of the element of claim 15 against a receptor sheet and imagewise heating the substrate so as to transfer said dye to said receptor sheet.

19. The thermal dye transfer imaging layer of claim 11 wherein said substrate has a thickness of less than 12 microns.

20. A process for thermal dye transfer imaging comprising the steps of placing the continuous layer of the element of claim 11 against a receptor sheet and imagewise heating the substrate so as to transfer said dye to said receptor sheet.

21. A thermal dye transfer imaging element comprising a continuous layer of at least one anthraquinone dye in a binder bonded to a substrate, said dye having a central nucleus of the formula:

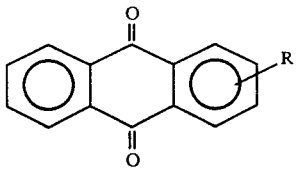

wherein R is $NR'SO_2R''$ and R′ is H or alkyl group of 1 to 4 carbon atoms and R″ is selected from the group consisting of alkyl group, aryl group, and hetercyclic group.

22. A thermal dye transfer imaging element comprising a continuous layer of at least one anthraquinone dye in a polymeric binder, said dye comprising up to 99% by weight of the total weight of dye and binder, said continuous layer being bonded to a substrate, said dye having a central nucleus of the formula:

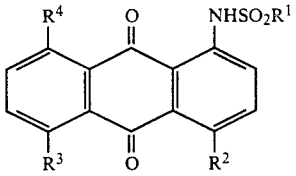

wherein $R^1$ is an alkyl group comprising two or more carbon atoms, and does not have a halogen substituent on the carbon alpha to the sulfur atom; $R^2$—$R^4$ may be any group other than auxochromic groups.

23. A thermal dye transfer imaging element comprising a continuous layer of at least one anthraquinone dye in a polymeric binder, said dye comprising up to 99% by weight of the total weight of dye and binder, said continues layer being bonded to a substrate, said dye having a central nucleus of the formula:

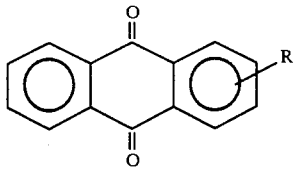

wherein R is $NHSO_2R''$, and R″ is alkyl group, aryl group, or a heterocyclic group.

24. The element of claim 23 wherein R″ is an alkyl of 1 to 20 carbon atoms, an aryl group of up to 20 carbon atoms, or a heterocyclic group of up to 16 carbon atoms.

25. The element of claim 24 wherein the core anthraquinone nucleus has no groups besides R bonded thereto.

* * * * *

UNITED STATES PATENT AND TRADEMARK OFFICE

CERTIFICATE OF CORRECTION

PATENT NO. : 5,061,678

DATED : October 29, 1991

INVENTOR(S) : Susan K. Jongewaard, Louis M. Leichter, Terrance P. Smith and Krzysztof A. Zaklika It is certified that error appears in the above-identified patent and that said Letters Patent is hereby corrected as shown below:

Column 1, line 58, "Chem. rit.," should read --Chem. Brit.,--.

Column 3, line 19, "10°C," should read --310°C,--.

Column 8, line 46-47, "number wire-wound" should read --number 8 wire-wound--.

Column 13, line 21, "claim 11" should read --claim 2--.

Column 13, line 26, "claim 15" should read --claim 3--.

Column 13, line 29-30, "claim 11" should read --claim 2--.

Signed and Sealed this

First Day of February, 1994

Bruce Lehman

*Attest:*

BRUCE LEHMAN

*Attesting Officer*

*Commissioner of Patents and Trademarks*